US007441780B1

(12) United States Patent
Minor

(10) Patent No.: US 7,441,780 B1
(45) Date of Patent: Oct. 28, 2008

(54) BALANCING GAME METHOD AND APPARATUS

(76) Inventor: Francis G. Minor, 175 Howells Hill Rd., Portage, PA (US) 15946

( * ) Notice: Subject to any disclaimer, the term of this patent is extended or adjusted under 35 U.S.C. 154(b) by 328 days.

(21) Appl. No.: 11/450,980

(22) Filed: Jun. 9, 2006

(51) Int. Cl.
*A63F 9/26* (2006.01)

(52) U.S. Cl. ..... 273/449

(58) Field of Classification Search ..... 273/440, 273/441, 449, 109; 446/396; 482/34
See application file for complete search history.

(56) References Cited

U.S. PATENT DOCUMENTS

| | | | | | |
|---|---|---|---|---|---|
| 2,167,992 | A | | 8/1939 | Olsen | |
| 3,010,721 | A | | 11/1961 | Ellman | |
| 3,389,910 | A | * | 6/1968 | Kanzler, Jr. | 273/449 |
| 3,404,884 | A | * | 10/1968 | Sorenson et al. | 482/34 |
| 3,510,129 | A | * | 5/1970 | Reuther | 482/34 |
| 3,545,747 | A | * | 12/1970 | Thomas | 273/449 |
| 3,837,644 | A | * | 9/1974 | Stinchcomb | 273/449 |
| 4,378,112 | A | * | 3/1983 | Goldstein | 482/34 |
| 4,787,631 | A | * | 11/1988 | Erumsele | 273/445 |
| D308,698 | S | * | 6/1990 | Dorman | D19/59 |
| 5,180,349 | A | * | 1/1993 | Marcus | 482/34 |
| 5,242,165 | A | | 9/1993 | Shubert | |
| 5,389,054 | A | * | 2/1995 | Dorman | 482/34 |
| 5,788,590 | A | | 8/1998 | Ervin | |
| 6,544,095 | B1 | | 4/2003 | Zimmerman | |
| D485,869 | S | | 1/2004 | Miletich | |

* cited by examiner

*Primary Examiner*—Raleigh W. Chiu

(57) ABSTRACT

A balancing game method and apparatus includes an elongated member having a first end and a second end. The elongated member has an arcuate upper surface. The elongated member has a plurality of scoring sections thereon. Each of the scoring sections has scoring indicia thereon. The scoring indicia increases from the first end to the second end of the elongated member. A stand supports the elongated member over a support surface. The elongated member is angled downwardly from the first end to the second end. A tubular member has a length less than a length of the elongated member. The tubular member is rolled down the upper surface of the elongated member by a player and the player scores a number of points equal to a position of the tubular member falling off of the elongated member relative to one of the scoring sections.

6 Claims, 3 Drawing Sheets

BALANCING GAME METHOD AND APPARATUS

BACKGROUND OF THE INVENTION

1. Field of the Invention

The present invention relates to balancing games and more particularly pertains to a new balancing game consisting of rolling and balancing a tubular member on an elongated member.

2. Description of the Prior Art

The use of balancing games is known in the prior art. While these devices fulfill their respective, particular objectives and requirements, the need remains for a balancing game that allows a person to roll one tubular member down an elongated member, which is angled downwardly. A player who rolls the tubular member further down the elongated member before it falls off of the elongated member is the winner of the game.

SUMMARY OF THE INVENTION

The present invention meets the needs presented above by generally comprising providing an elongated member having a first end and a second end. The elongated member has an arcuate upper surface. The elongated member has a plurality of scoring sections thereon and aligned with each other from the first end to the second end. Each of the scoring sections has a scoring indicia thereon. The scoring indicia increases from the first end to the second end of the elongated member. A stand supports the elongated member over a support surface and the elongated member is angled downwardly from the first end to the second end. A tubular member has a length less than a length of the elongated member. The tubular member is rolled for a selected number of turns by each of a plurality of players down the upper surface of the elongated member from the first end and toward the second end. Each of the players scores a number of points equal to a position of the tubular member falling off of the elongated member relative to one of the scoring sections. The game is won by the person who has the most points after the tubular member has been rolled the selected amount of times by each player.

The present invention further meets the needs presented above by generally comprising an elongated member having a first end and a second end. The elongated member has an arcuate upper surface. The elongated member has a plurality of scoring sections thereon and aligned with each other from the first end to the second end. Each of the scoring sections has scoring indicia thereon. The scoring indicia increases from the first end to the second end of the elongated member. A stand supports the elongated member over a support surface. The elongated member is angled downwardly from the first end to the second end. A tubular member has a length less than a length of the elongated member. The tubular member is rolled down the upper surface of the elongated member by a player and the player scores a number of points equal to a position of the tubular member falling off of the elongated member relative to one of the scoring sections.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
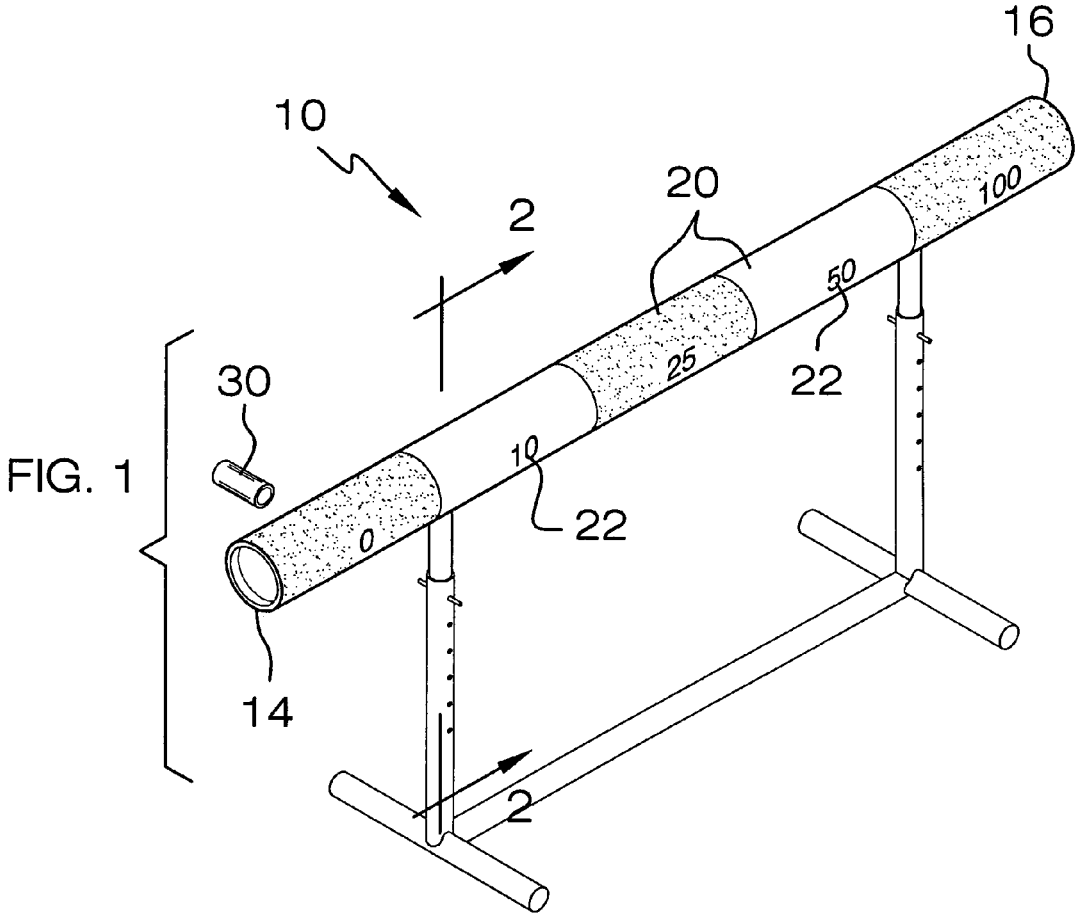
FIG. 1 is a perspective view of a balancing game method and apparatus according to the present invention.
Figure 2:
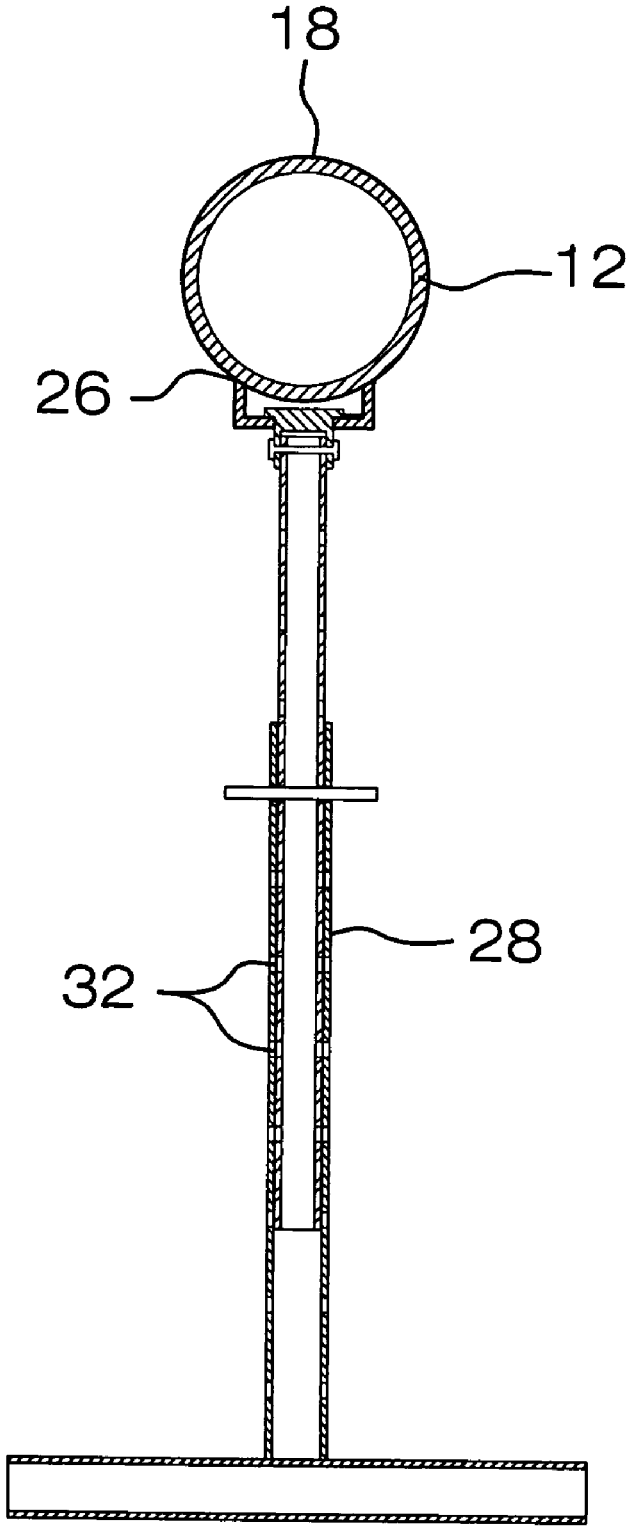
FIG. 2 is a cross-sectional view taken along line 2-2 of FIG. 1 of the present invention.
Figure 3:
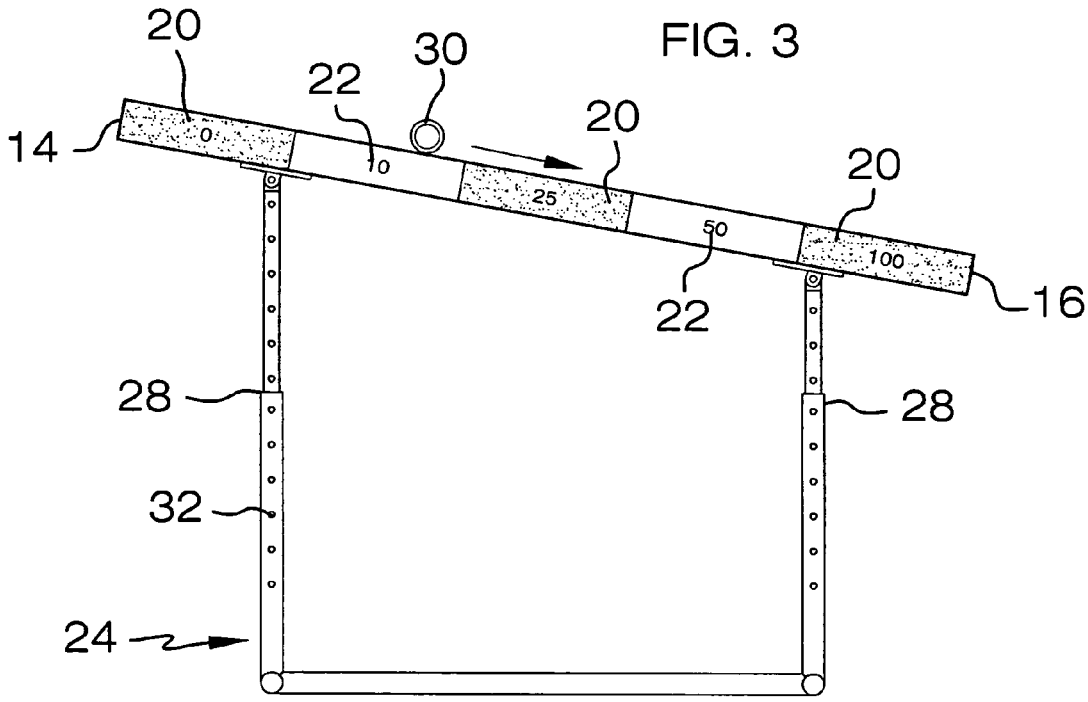
FIG. 3 is a side view of the present invention.
Figure 4:
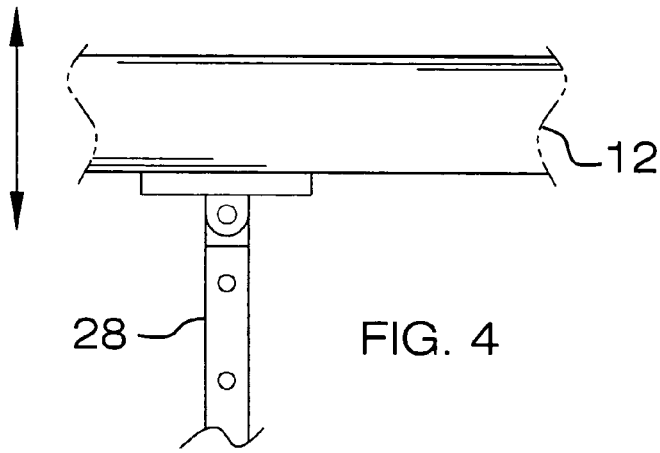
FIG. 4 is an enlarged view of a portion of a leg of the present invention.

With reference now to the drawings, and in particular to FIGS. 1 through 4 thereof, a new balancing game embodying the principles and concepts of the present invention and generally designated by the reference numeral 10 will be described.

As best illustrated in FIGS. 1 through 4, the balancing game 10 method and apparatus generally comprises an elongated member 12 that has a first end 14 and a second end 16. The elongated member 12 has an arcuate upper surface 18. The elongated member 12 has a plurality of scoring sections 20 thereon and aligned with each other from the first end 14 to the second end 16. Each of the scoring sections 20 has a substantially equal length with respect to each other. The scoring sections 20 each have scoring indicia 22 thereon. The scoring indicia 22 increases from the first end 14 to the second end 16 of the elongated member 12. The plurality of scoring sections 20 includes five scoring sections. The scoring indicia 22 increases from zero points to one hundred points as shown in FIG. 1.

The elongated member 12 is positioned on a stand 24 and supported by the stand 24 over a support surface, such a ground surface or floor. A bottom surface 26 of the elongated member 12 is pivotally coupled to the stand 24 adjacent to the second end 16. A height between the support surface and the first end 14 is selectively adjustable between a plurality of downwardly orientated slopes. As is shown in FIG. 1, the stand 24 may include a pair of legs 28 each pivotally attached to the elongated member 12. At least one of the legs 28 has an adjustable height to vary the height of the first end 14, though each might have adjustable heights so that each leg 28 may be adjusted depending on the height of players of the game.

A tubular member 30 is also provided which has a length less than a length of the elongated member 12. The length of the tubular member 30 is preferably less than ⅕ the length of the elongated member 12.

To play the game 10, the first end 14 is positioned at a first increment setting with respect to a horizontal wherein the elongated member 12 is angled downwardly from the first end 14 to the second end 16. The players may choose which setting should be the first increment. The players, in turn, then roll the tubular member 30 for a selected number of turns down the upper surface 18 of the elongated member from the first end 14 and toward the second end 16. Each of the players scores a number of points equal to a position of the tubular member falling off of the elongated member 12 relative to one of the scoring sections 20. In other words, if the tubular member 30 falls off of the elongated member 12 at the scoring section 20 having a fifty point indicia thereon, the player will receive 50 points.

The players next reposition the first end 14 at each of a plurality of central increment settings and repeat the step of rolling the tubular member 30 for the selected number of turns. The number of central increments may be set by a number of slots 32 in the legs 28, or the players may determine to play only selected ones of the central increments. Each repositioning places the elongated member 12 closer to a horizontal orientation. This increases the difficulty of the game 10 as it is played because a lower inclination of the elongated member 12 causes the tubular member 30 to roll slower. Each of the players again scores a number of points equal to a position of the tubular member 30 falling off of the elongated member 12 relative to one of the scoring sections 20.

The game is won by the person that has the most points after the tubular member has been rolled the selected amount of times by each player at the lowest increment setting. The lowest increment setting may be the lowest slot on the leg attached adjacent to the first end, or the lowest setting decided by the players.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a rod balancing game comprising the steps of:

providing an elongated member having a first end and a second end, said elongated member having an arcuate upper surface, said elongated member having a plurality of scoring sections thereon and aligned with each other from said first end to said second end, each of said scoring sections having a scoring indicia thereon, said scoring indicia increasing from said first end to said second end of said elongated member;

providing a stand, said elongated member being positioned on said stand and supported by said stand over a support surface, said elongated member being angled downwardly from said first end to said second end;

providing a tubular member having a length less than a length of said elongated member;

rolling said tubular member for a selected number of turns by each of a plurality of players down said upper surface of said elongated member from said first end and toward said second end, wherein each of the players scores a number of points equal to a position of said tubular member falling off of said elongated member relative to one of said scoring sections; and winning the game by the person having the most points after the tubular member has been rolled the selected amount of times by each player.

2. A method of playing a rod balancing game comprising the steps of:

providing an elongated member having a first end and a second end, said elongated member having an arcuate upper surface, said elongated member having a plurality of scoring sections thereon and aligned with each other from said first end to said second end, each of said scoring sections having a substantially equal length with respect to each other, each of said scoring sections having a scoring indicia thereon, said scoring indicia increasing from said first end to said second end of said elongated member, said plurality of scoring sections including five scoring sections;

providing a stand, said elongated member being positioned on said stand and supported by said stand over a support surface, a bottom surface of said elongated member being pivotally coupled to said stand adjacent to said second end, a height between the support surface and said first end being selectively adjustable between a plurality of downwardly orientated slopes;

providing a tubular member having a length less than a length of said elongated member;

positioning said first end at a first increment setting with respect to a horizontal wherein said elongated member is angled downwardly from said first end to said second end;

rolling said tubular member for a selected number of turns by each of a plurality of players down said upper surface of said elongated member from said first end and toward said second end, wherein each of the players scores a number of points equal to a position of said tubular member falling off of said elongated member relative to one of said scoring sections;

repositioning said first end at each of a plurality of central increment settings and repeating the step of rolling said tubular member for the selected number of turns, wherein each repositioning places said elongated member closer to a horizontal orientation, wherein each of the players again scores a number of points equal to a position of said tubular member falling off of said elongated member relative to one of said scoring sections; and winning the game by the person having the most points after the tubular member has been rolled the selected amount of times by each player on a lowest increment setting.

3. A balancing game comprising:

an elongated member having a first end and a second end, said elongated member having an arcuate upper surface, said elongated member having a plurality of scoring sections thereon and aligned with each other from said first end to said second end, each of said scoring sections having a scoring indicia thereon, said scoring indicia increasing from said first end to said second end of said elongated member;

a stand supporting said elongated member over a support surface, said elongated member being angled downwardly from said first end to said second end;

a tubular member having a length less than a length of said elongated member; and wherein the tubular member may be rolled down the upper surface of the elongated member by a player and the player scores a number of points equal to a position of said tubular member falling off of said elongated member relative to one of said scoring sections.

4. The game according to claim 3, wherein each of said scoring sections has a substantially equal length with respect to each other.

5. The game according to claim 4, wherein said plurality of scoring sections includes five scoring sections.

6. The game according to claim 3, wherein a bottom surface of said elongated member is pivotally coupled to said stand adjacent to said second end, a height between the support surface and said first end being selectively adjustable between a plurality of downwardly orientated slopes.

* * * * *